US009855568B2

(12) United States Patent
Hawkins

(10) Patent No.: US 9,855,568 B2
(45) Date of Patent: Jan. 2, 2018

(54) SHOWERHEAD WITH DETACHABLE FACE

(71) Applicant: FAN FI INTERNATIONAL, INC., Reno, NV (US)

(72) Inventor: Travis Hawkins, Reno, NV (US)

(73) Assignee: FAN FI INTERNATIONAL, INC., Reno ( * ) Notice: Subject to any disclaimer, the term of this patent is extended or adjusted under 35 U.S.C. 154(b) by 1 day.

(21) Appl. No.: 14/704,106

(22) Filed: May 5, 2015

(65) Prior Publication Data

US 2016/0325292 A1 Nov. 10, 2016

(51) Int. Cl.
*B05B 1/14* (2006.01)
*B05B 1/18* (2006.01)

(52) U.S. Cl.
CPC ..... *B05B 1/18* (2013.01); *B05B 1/185* (2013.01)

(58) Field of Classification Search
CPC ..... B05B 1/18; B05B 15/065; B05B 1/185; B05B 1/14
USPC ..... 239/548, 567, 533, 600
See application file for complete search history.

(56) References Cited

U.S. PATENT DOCUMENTS 4,821,960 A 4/1989 Goldman
6,446,278 B1 9/2002 Lin
7,251,844 B2 8/2007 Tai et al.
8,205,846 B2 6/2012 Glunk
8,387,661 B2 5/2013 Nelson
2004/0078891 A1* 4/2004 Yip ..... B05B 1/18 4/615
2005/0284967 A1* 12/2005 Korb ..... B05B 1/18 239/552
2006/0196972 A1* 9/2006 Kajuch ..... B05B 1/18 239/451
2009/0007330 A1 1/2009 Genord et al.
2009/0289129 A1* 11/2009 Qiu ..... B05B 1/1618 239/550
2011/0133003 A1* 6/2011 Lu ..... B05B 1/1645 239/587.5
2013/0299608 A1* 11/2013 Spangler ..... B05B 1/08 239/444
2013/0320116 A1 12/2013 Jonte et al.
2014/0131482 A1* 5/2014 Wu ..... B05B 7/24 239/302
2014/0145010 A1* 5/2014 Lin ..... B05B 1/18 239/418
2014/0332608 A1* 11/2014 Harwanko ..... B05B 1/185 239/553.5
2015/0122913 A1* 5/2015 Wang ..... B05B 1/18 239/289
2015/0208152 A1* 7/2015 Hanna ..... B05B 1/185 239/289
2016/0318045 A1* 11/2016 Huffington ..... B05B 1/185

* cited by examiner

*Primary Examiner* — Arthur O Hall
*Assistant Examiner* — Adam J Rogers
(74) *Attorney, Agent, or Firm* — David G. Duckworth

(57) ABSTRACT

A showerhead assembly is provided including a showerhead and a faceplate which is attachable and detachable to the showerhead's front face. The showerhead includes a plurality of nozzles. Meanwhile, the faceplate includes bore holes for receiving the nozzles. The bore holes are sized so as to have a circular outlet having a diameter smaller than the received nozzle's distal end. However, each bore holes' circular outlet has a diameter larger than a received nozzle's circular outlet so as to not impede the spray of water from the nozzles.

5 Claims, 6 Drawing Sheets

SHOWERHEAD WITH DETACHABLE FACE

BACKGROUND OF THE INVENTION

The present invention relates to showerheads. More particularly, the present invention relates to handheld showerheads.

Showerheads are commercially available in numerous designs and configurations for use in showers, faucets, spas, sprinklers and other personal and industrial systems. Showerheads may be categorized as being either stationary or oscillating and may have fixed or adjustable openings. Stationary showerheads with fixed jets are the simplest construction consisting of a central conduit which connects a water source to one or more spray jets directed to produce a constant pattern. Multi-function showerheads are able to deliver water in different spray patterns such as a fine spray, a coarse spray, a pulsating spray, or even a flood pattern producing a high fluid flow.

A handheld showerhead assembly typically includes a hollow handle connected to a water supply by a flexible rubber hose. The handle has a proximal end which typically has a threaded inlet for connecting to the rubber hose. Meanwhile, at the handle's distal end, the showerhead assembly includes a showerhead including a plurality of nozzles for ejecting water. Typically, the handle and showerhead face are angled relative to one another so that water is ejected at approximately 90° relative to the handle's longitudinal axis.

Unfortunately, showerheads are not particularly attractive. Sellers of showerheads have attempted to manufacture showerheads with decorative materials and designs. U.S. Pat. No. 4,821,960 is directed to an ornamental covering for the showerhead. Unfortunately, the showerhead's nozzles are still conspicuously visible. U.S. Pat. No. 6,446,278 describes a wall plate for supporting the showerhead which includes decorative features to improve the aesthetics of the nearby vicinity. However, the aesthetics of the showerhead are not improved.

Various attempts have been made to provide replaceable showerhead nozzles. To this end, showerheads have been constructed to include a face which can detach from the showerhead assembly so as to provide a substitute face with different nozzles. Advantageously, these constructions permit a user to switch the spray patterns of the showerhead, but the showerheads remain aesthetically unpleasing.

Accordingly, there is a need for a showerhead assembly which provides better aesthetic appeal.

Furthermore, there is a need for a showerhead assembly that enables a user to select different aesthetic designs.

There is still an additional need for showerhead assemblies which minimize the appearance of the nozzles which are aesthetically unpleasing.

SUMMARY OF THE INVENTION

The present invention addresses the aforementioned disadvantages by providing an improved showerhead assembly with a detachable faceplate. The showerhead assembly may be a conventional showerhead including a female threaded inlet for affixing directly to a male threaded pipe which would typically extend from a shower stall wall. Alternatively, the showerhead assembly may be constructed as a handheld showerhead including a hollow elongate handle and a flexible rubber hose to connect to a water supply. For either of these embodiments, the showerhead includes a housing having a front face with a plurality of nozzles for providing a spray pattern. The nozzles are connected to the showerhead's inlet by one or more conduits which extend through the showerhead housing. The showerhead may or may not contain a controller for allowing one to alter the flow of water through discrete pathways to provide different flow patterns. For example, the showerhead may include a tab for allowing one to rotate the tab to different positions so as to obstruct or unobstruct different conduits to control the flow of water to different nozzles, such as a jet nozzle, wide spray nozzles, and/or massage nozzles. Mechanisms for controlling the flow of water and/or spray patterns can be selected by those skilled in the art without undue experimentation.

The showerhead nozzles project distally from the showerhead's face. In addition, each of the nozzles are preferably frustoconical in shape. Due to the frustoconical shape of the nozzles, each nozzle has a circular shape at the nozzle's distal end. In addition, each nozzle has a circular outlet for expelling water received from the showerhead's one or more conduits.

The showerhead assembly further includes a faceplate which is attachable and detachable to the showerhead's front face. The faceplate has an engagement surface for engaging the showerhead's front face and an opposite exposed surface which is seen by one showering with the showerhead assembly. The faceplate includes a plurality of bore holes which extend from the faceplate's engagement surface to the faceplate's exposed surface. The bore holes are sized for receiving the showerhead's nozzles. Each of the bore holes are sized to receive a corresponding showerhead nozzle with the nozzle not projecting entirely through the faceplate. Moreover, each of the bore holes have a circular outlet having a diameter smaller than a nozzle's distal end which is received in such bore hole. By constructing each of the bore holes circular outlets smaller than a received nozzle's distal end, each nozzle's distal end is at least partially covered, and preferably almost entirely covered, so as to not be seen by one taking a shower. Meanwhile, each of the bore holes circular outlets have a diameter larger than a received nozzle's circular outlet so that water ejected from a nozzle is not impeded by the faceplate.

The showerhead assembly further includes a fastener for affixing the faceplate to the showerhead's front face. Suitable fasteners can be selected by those skilled in the art. However, it is preferred that the fastener is capable of firmly affixing a faceplate to the showerhead's front face without the use of tools. Suitable fasteners include a press-fit arrangement, and hook and pile fasteners, among the many other types of fasteners which would be acceptable. However, the preferred fastener incorporates one or more magnets positioned within the showerhead and/or detachable faceplate so as to provide a magnetic coupling between the showerhead and faceplate.

Advantageously, the showerhead assembly and detachable faceplate provide a showerhead assembly which does not have any nozzles which are significantly seen by one using the showerhead assembly. Thus, the showerhead assembly provides improved aesthetics. Moreover, the detachable faceplate can be removed and substituted with other faceplates having different aesthetic designs. Accordingly, in another object of the invention, a kit is provided including a showerhead and two or more faceplates which can be interchangeably substituted for one another. Preferably, the faceplates have different decorative design elements so as to provide a kit enabling a user to create a showerhead assembly that has a visual appearance that can be altered in accordance with the mood and whims of the user. Advantageously, each faceplate in the kit is constructed to include bore holes sized sufficiently small so as to at least partially cover the showerhead nozzles' distal ends. However, the faceplate's bore holes are sufficiently large so as to not impede the ejection of water from the nozzles.

DETAILED DESCRIPTION OF THE INVENTION

DETAILED DESCRIPTION OF THE INVENTION

Figure 1:
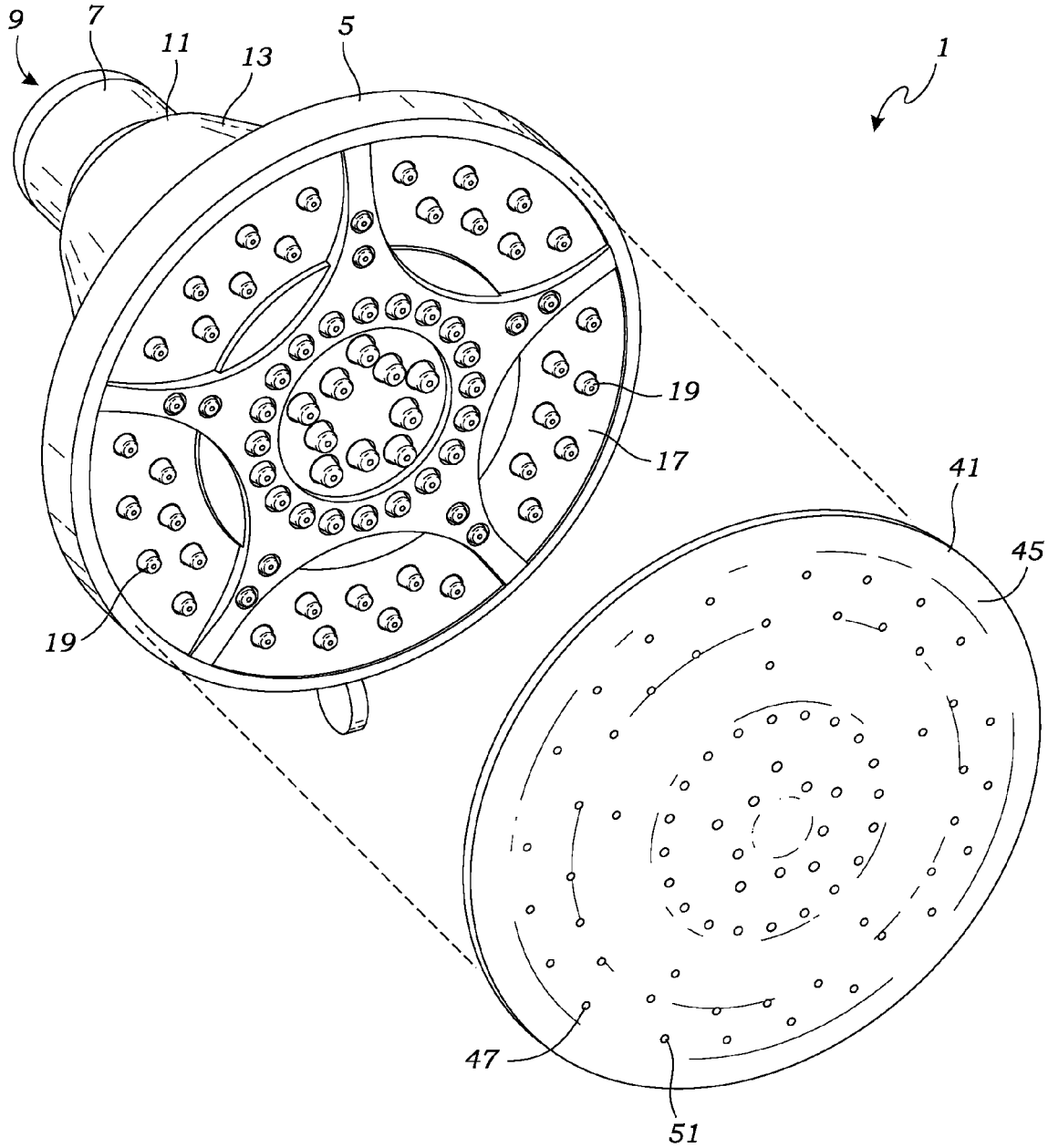
FIG. 1 is perspective exploded view of a showerhead assembly with a detachable faceplate.
Figure 2:
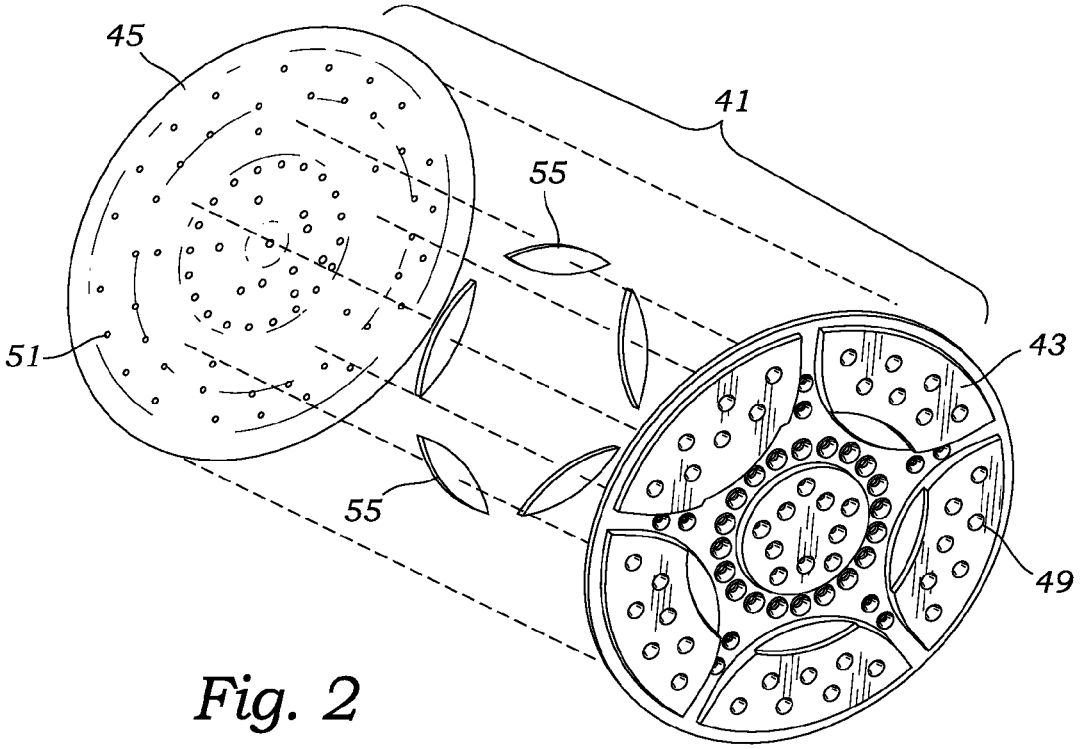
FIG. 2 is a rear exploded view of a detachable faceplate including magnets.

While the present invention is susceptible of embodiment in various forms, as shown in the drawings, hereinafter will be described the presently preferred embodiments of the invention with the understanding that the present disclosure is to be considered as an exemplification of the invention, and the present disclosure is not intended to limit the invention to the specific embodiments illustrated.

With reference to FIGS. 1-10, a showerhead assembly 1 is provided including a showerhead 5 and a faceplate 41. The showerhead assembly may be constructed to include hand-held structures including a hollow handle and flexible rubber hose for connecting to a water source. However, a preferred showerhead assembly 1 is constructed in the manner of a conventional showerhead assembly that includes a female threaded inlet 9 for connecting directly to the male threaded pipe typically found in a shower stall. To this end, a preferred showerhead 5 includes a hollow neck portion 7 including a ball joint 11. The showerhead 5 further includes a housing 13 including a receptacle (not shown) for receiving the ball joint 11 and for permitting the showerhead housing 13 to pivot relative to the hollow neck portion 7.

The showerhead housing 13 includes a front face 17 which includes one or more nozzles 19 for providing a spray pattern. The nozzles 19 are connected to the showerhead's hollow neck portion 7 by conduits 15 for permitting the passage of water from the water source.

Figure 6:
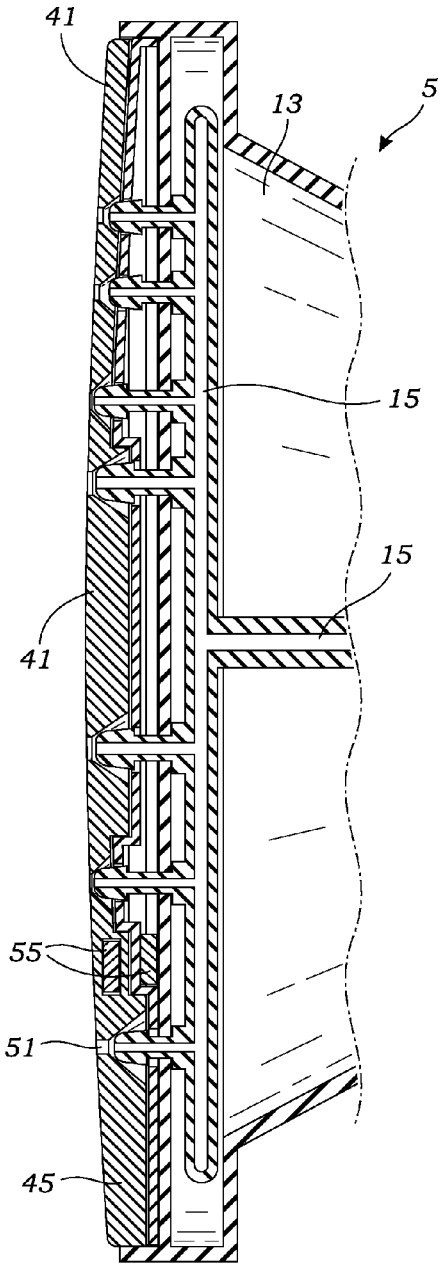
FIG. 6 is a side cut-away view of the showerhead assembly illustrated in FIG. 3.
Figure 7:
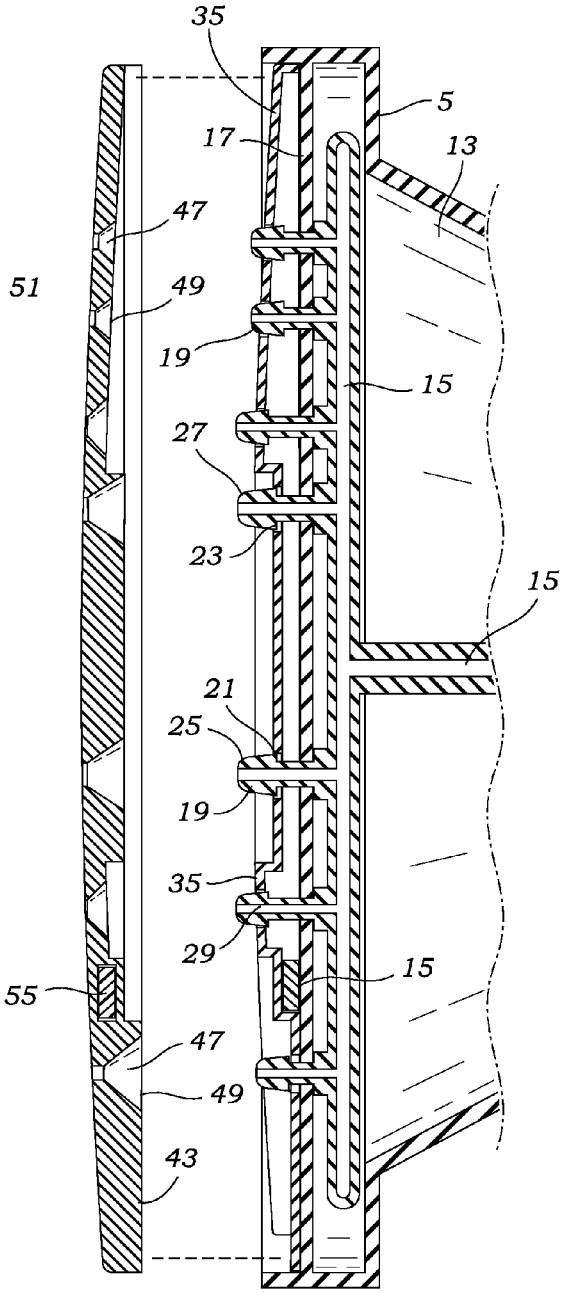
FIG. 7 is a side cut-away exploded view of the showerhead assembly illustrated in FIG. 6.
Figure 8:
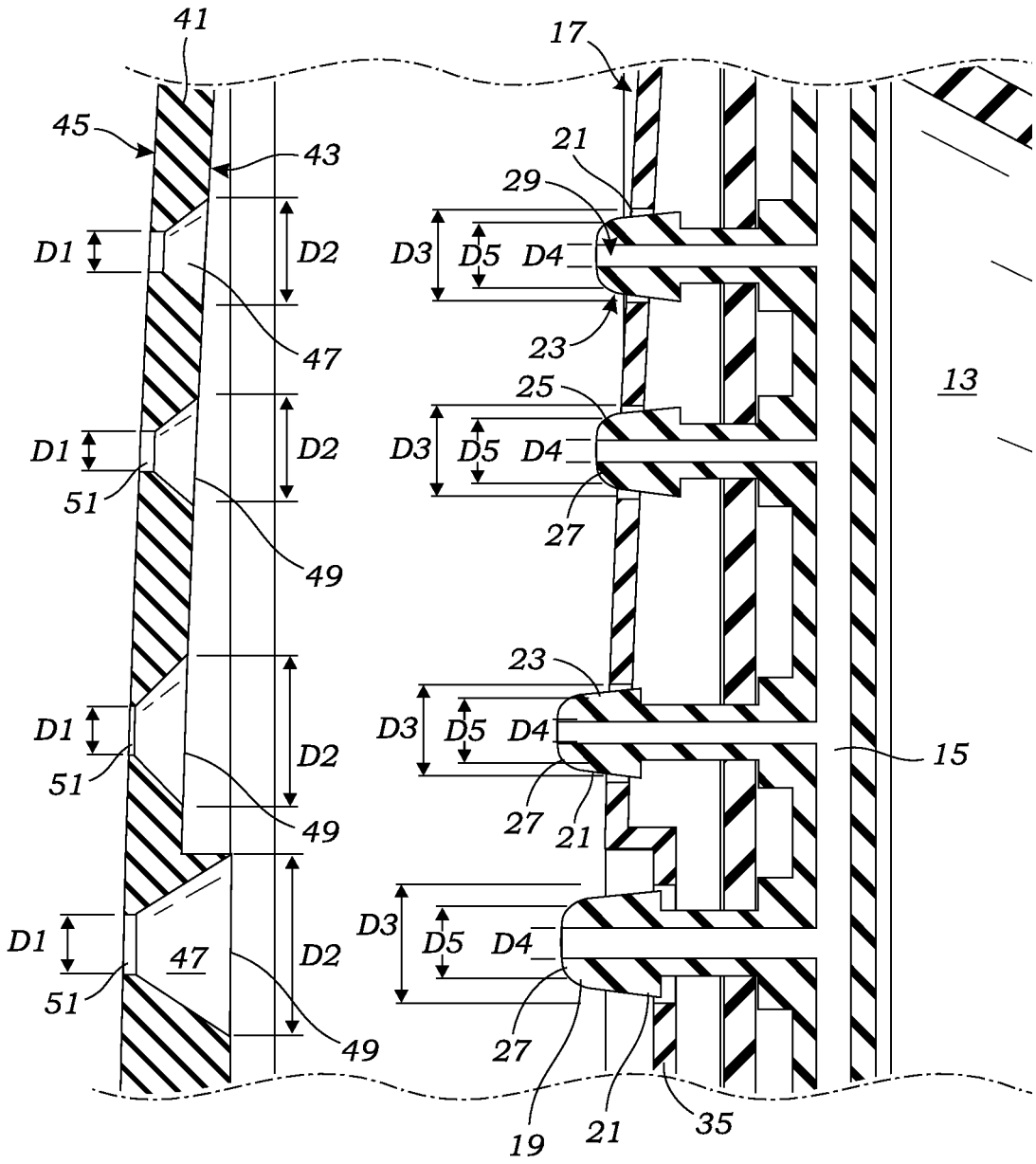
FIG. 8 is an exploded side cut-away view of the showerhead assembly.

With reference primarily to FIGS. 6-8, the nozzles 19 extend distally from the showerhead's front face 17 so that each nozzle has a proximal end 21 and a distal end 25. The nozzles are substantially frustoconically shaped so as to have a substantially circular base 23 and a substantially circular tip 27 wherein the tip has a diameter smaller than the nozzle's base. As best seen in FIG. 7, the term frustoconical is meant to be interpreted broadly such that the nozzle does not require perfectly planar sidewalls. For example, FIGS. 6-8 illustrate a nozzle embodiment including a curved tip. However, frustoconical is meant to mean that the nozzle's base has a diameter greater than the nozzle's tip. In addition, each of the showerhead nozzles 19 include a passageway 29 having an inlet 31 connected to the showerhead's conduits 15 and an outlet 33 for expelling water to provide a showerhead spray.

The showerhead assembly 1 also includes a faceplate 41 which may be attached and detached to and from the showerhead's front face 17. The faceplate 41 has an engagement side 43 for engaging the showerhead's front face 17 and an exposed side 45 which forms the exposed surface of the showerhead assembly. The faceplate includes bore holes 47 of equal number as the showerhead nozzles 19. Each of the bore holes 47 is sized and positioned to receive a corresponding nozzle 19 when the faceplate is positioned to engage the showerhead's front face 17. The bore holes extend entirely through the faceplate so as to include an inlet 49 and an outlet 51. As best seen in FIGS. 6 and 7, the length of the bore holes 47 is sufficient so that the nozzles 19 do not extend entirely through the bore holes.

Figure 3:
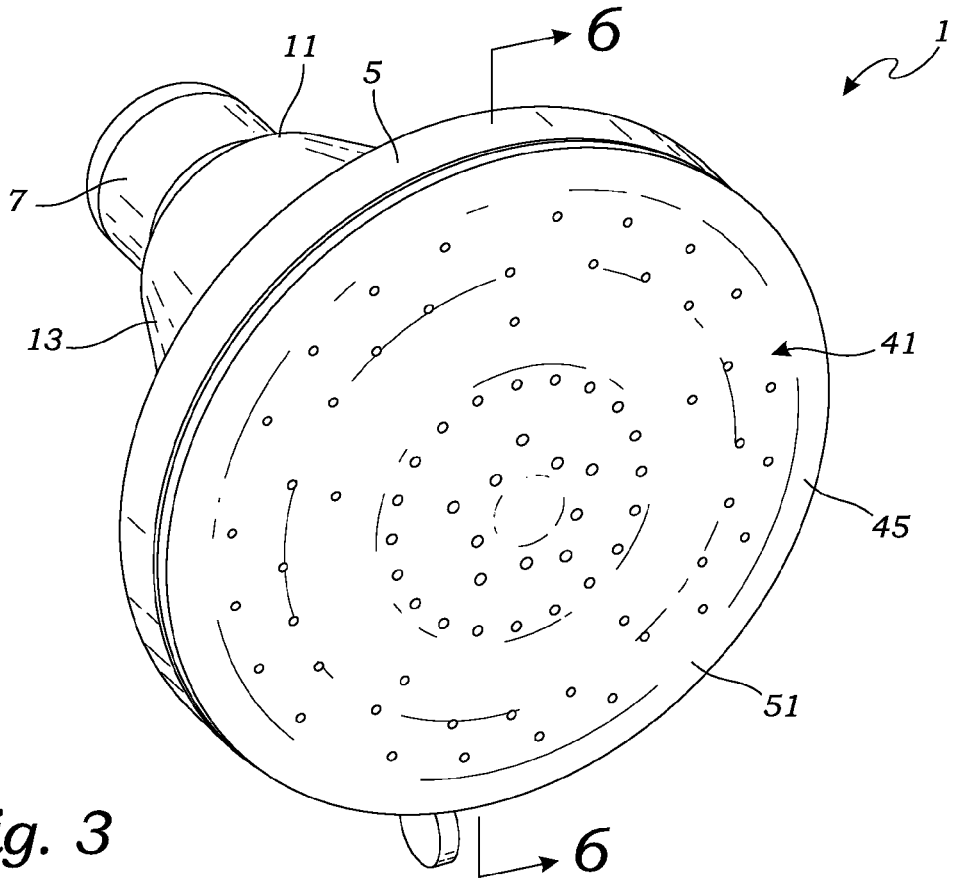
FIG. 3 is a front perspective view of the showerhead assembly including detachable face plate.

Also with reference to FIG. 8, each of the bore holes' inlets 49 has a diameter D2 which is sufficiently large as to allow receipt of a corresponding nozzle 19 into the bore hole 47. However, each of the bore holes' outlets 51 has a diameter D1 which is smaller than the diameter D5 of the nozzles' distal end 25. As illustrated in FIGS. 3 and 6, by constructing the bore holes' outlets smaller than the nozzles' distal ends 25 results in the nozzles' distal ends being at least partially covered so as to not be seen by one taking a shower. Conversely, each of the bore holes' outlets 51 are constructed to have a diameter D1 larger than a received nozzle's circular outlet D4 so that water ejected from the nozzle's outlet 33 is not impeded by the faceplate 41.

Figure 4:
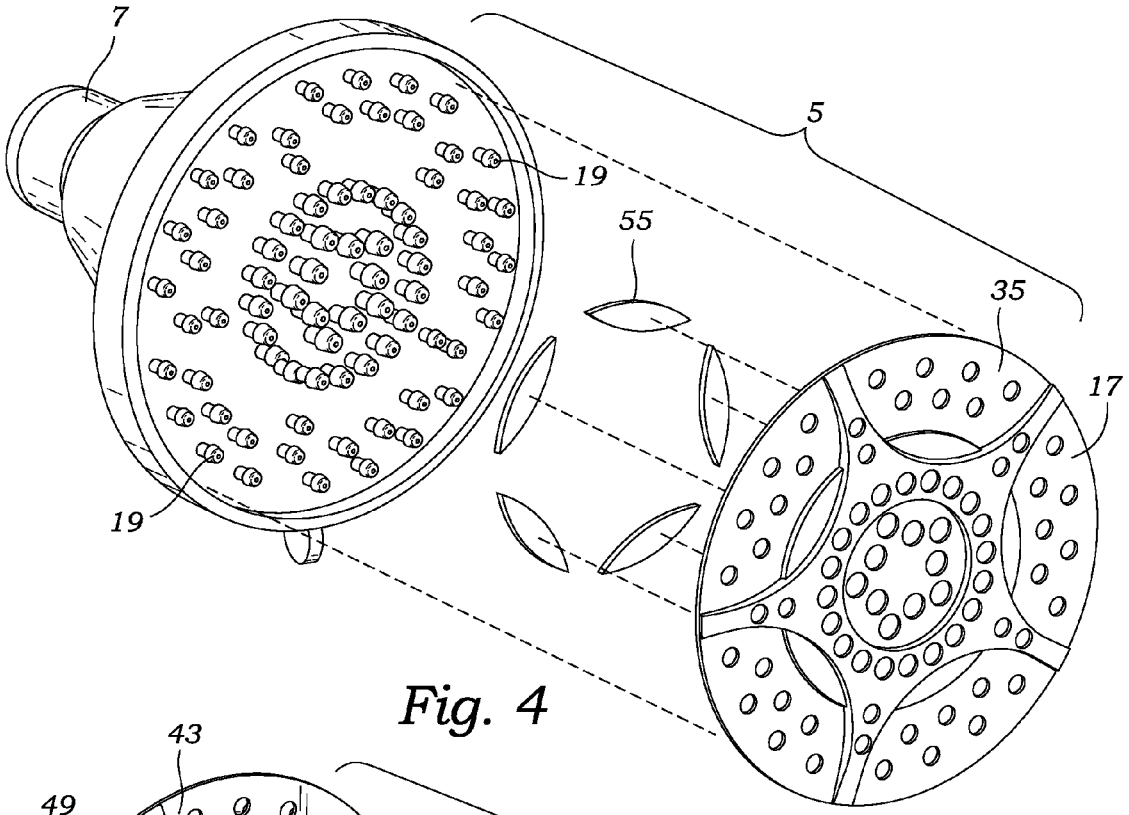
FIG. 4 is a front perspective exploded view of the showerhead assemby's showerhead illustrating the positioning of magnets.
Figure 5:
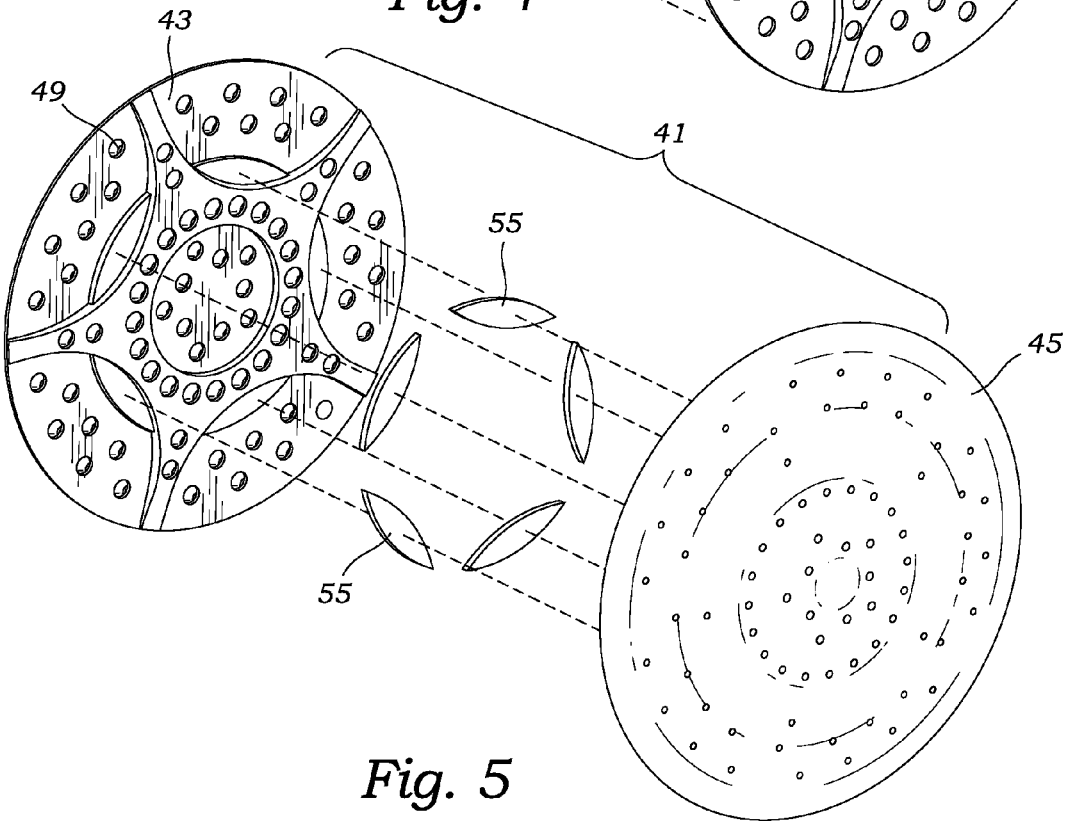
FIG. 5 is a front perspective view of a faceplate including illustration of placement of magnets.

The faceplate 41 can be affixed to the showerhead's front face 17 by various fasteners as can be selected by those skilled in the art. However, in a preferred embodiment illustrated in FIGS. 2-6, the showerhead assembly includes a magnetic coupling including magnets 55 for affixing the faceplate 41 to the showerhead 5. The magnets may be positioned in either the showerhead's front face 17 or the faceplate 41, or as illustrated in the figures, within both. For example, FIG. 4 illustrates an embodiment wherein the showerhead's front face includes a cover 35 under which magnets 55 are positioned. Meanwhile, FIG. 5 illustrates an embodiment of the faceplate 41 where the faceplate has been constructed of two pieces including an engagement side 43 and an exposed side 45 between which magnets are positioned. As would be understood by those skilled in the art, both the showerhead front face 17 and faceplate 41 do not need to include magnets, as the showerhead or faceplate may include metal capable of a magnetic attraction to a magnet found in the other component.

Figure 9:
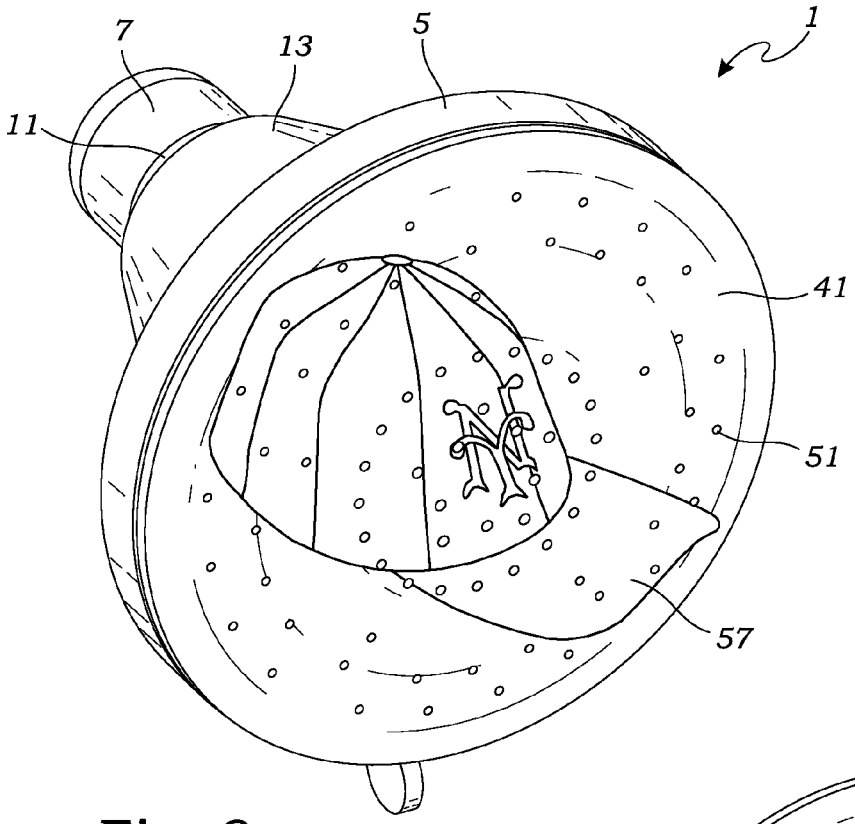
FIG. 9 is a front perspective view of the showerhead assembly including a first detachable faceplate having a first decorative design.
Figure 10:
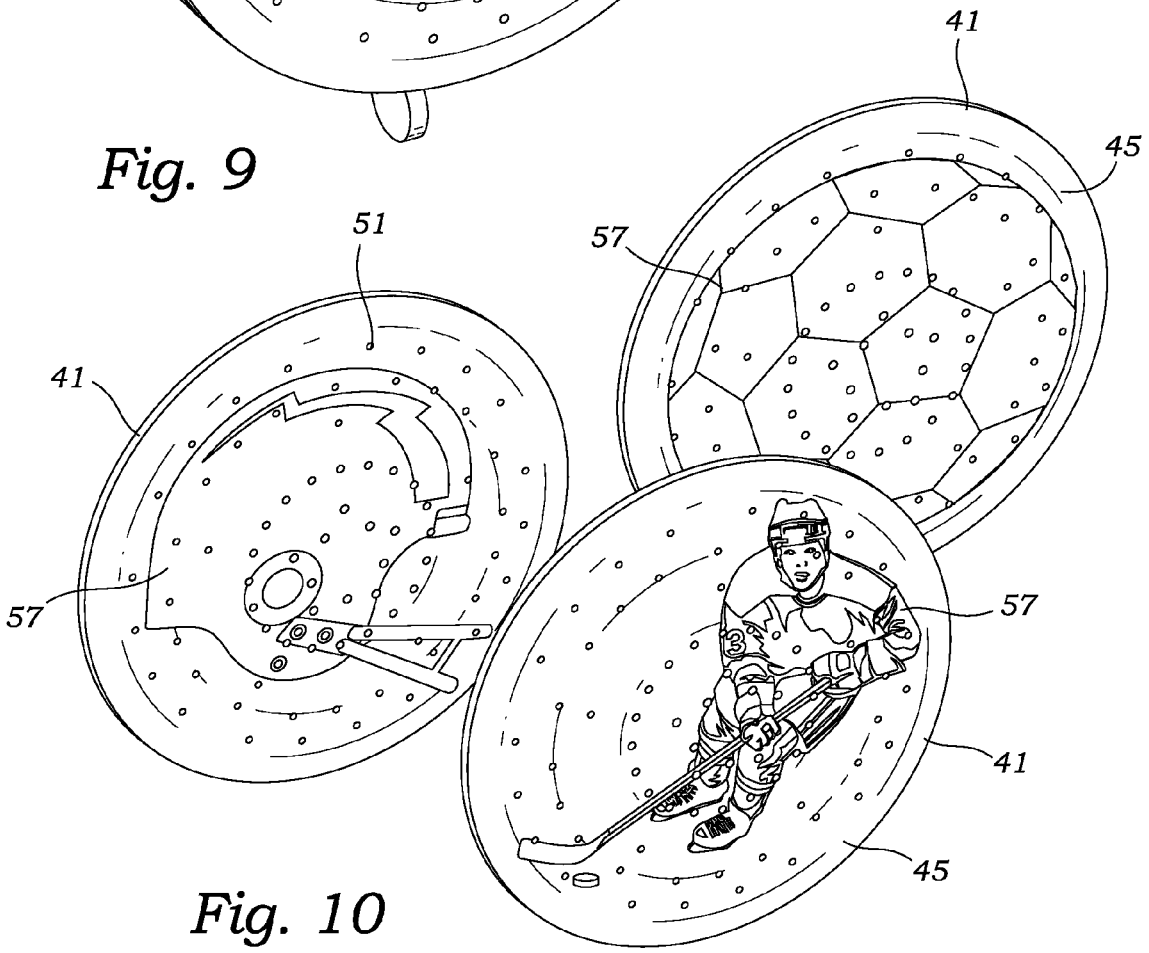
FIG. 10 is a front perspective view illustrating three detachable faceplates, each having a different decorative design.

As illustrated in FIGS. 3, 6, 9 and 10, the detachable faceplate 41 provides a showerhead assembly 1 which predominantly hides all of the nozzles 19 so as to provide a more aesthetically pleasing showerhead. In addition, preferably the faceplate's exposed surface 45 is substantially smooth and planar so as to provide a surface for different aesthetic designs 57. Moreover, it is preferred that that showerhead assembly 1 be prepackaged with two or more faceplates 41 wherein each faceplate has a different design to enable the buyer to alter the visual appearance of the showerhead. For example, FIGS. 9 and 10 illustrate various sports themes enabling a person using the showerhead to display a sport's theme which is current in accordance with the season.

While several particular forms of the invention have been illustrated and described, it will be apparent that various modifications can be made without departing from the spirit and scope of the invention. Therefore, it is not intended that the invention be limited except by the following claims.

Having described my invention in such terms so as to enable persons skilled in the art to understand the invention, recreate the invention and practice it, and having presently identified the presently preferred embodiments thereof, I claim:

1. A showerhead assembly with detachable faceplate comprising:

a showerhead including a front face, a conduit having an inlet connectable to a water source, and a plurality of nozzles projecting from said front face and connected to said conduit for receiving water from said conduit, each of said nozzles being substantially frustoconical so as to have a length extending from said front face and a diameter at its distal end, each of said nozzles further having a circular outlet for expelling water having a diameter which is smaller than the diameter of the nozzle's distal end;

a faceplate attachable and detachable to said showerhead's front face, said faceplate having an engagement surface engaging said showerhead face, an exposed surface and a plurality of bore holes extending from said engagement surface to said exposed surface for receiving said nozzles, each of said bore holes sized to receive a showerhead nozzle without allowing said nozzle's distal end to project entirely through said borehole to said faceplate's exposed surface, each of said bore holes having a circular outlet having a diameter smaller than a received nozzle's distal end so as to partially cover said nozzle's distal end, but each of said bore hole's circular outlets having a diameter larger than a received nozzle's circular outlet so as to not impede the ejection of water from said nozzle; and a fastener for affixing said faceplate to said showerhead's front face, said fastener allowing the manual engagement and disengagement of said faceplate from said showerhead face without the use of tools.

2. The showerhead assembly with detachable faceplate of claim 1 wherein said fastener includes a magnet within said faceplate and said showerhead includes metal positioned to be adjacent to said magnet.

3. The showerhead assembly with detachable faceplate of claim 1 wherein said fastener includes a magnet within said showerhead and said faceplate includes metal positioned to be adjacent to said magnet.

4. The showerhead assembly with detachable faceplate of claim 1 wherein said faceplate exposed surface includes a decorative design.

5. A kit for providing a showerhead assembly with detachable faceplates comprising:

a showerhead including a front face, a conduit having an inlet connectable to a water source, and a plurality of nozzles projecting from said front face and connected to said conduit for receiving water from said conduit, each of said nozzles being substantially frustoconical defining a length extending from said front face and a diameter at its distal end, each of said nozzles further having a circular outlet for expelling water having a diameter which is smaller than the diameter of the nozzle's distal end;

a first faceplate attachable and detachable to said showerhead's front face, said first faceplate having an engagement surface engaging said showerhead face, an exposed surface and a plurality of bore holes extending from said engagement surface to said exposed surface for receiving said nozzles, each of said bore holes sized to receive a showerhead nozzle without allowing said nozzle's distal end to project entirely through said borehole to said faceplate's exposed surface, each of said bore holes having a circular outlet having a diameter smaller than a received nozzle's distal end so as to partially cover said nozzle's distal end, but each of said bore hole's circular outlet's having a diameter larger than a received nozzle's circular outlet so as to not impede the ejection of water from said nozzle;

a second faceplate attachable and detachable to said showerhead's front face, said second faceplate having an engagement surface engaging said showerhead face, an exposed surface and a plurality of bore holes extending from said engagement surface to said exposed surface for receiving said nozzles, each of said bore holes sized to receive a showerhead nozzle without allowing said nozzle to project entirely through said borehole, each of said bore holes having a circular outlet having a diameter smaller than a received nozzle's distal end so as to partially cover said nozzle's distal end, but each of said bore hole's circular outlet's having a diameter larger than a received nozzle's circular outlet so as to not impede the ejection of water from said nozzle;

said first faceplate's front surface including a decorative design and said second faceplate's front surface including a decorative design different than the decorative design on said first faceplate; and a fastener for selectively affixing said first faceplate or said second faceplate to said showerhead's front face, said fastener allowing the manual engagement and disengagement of said faceplates from said showerhead face without the use of tools.

* * * * *